US005815093A

United States Patent [19]

Kikinis

[11] Patent Number: 5,815,093

[45] Date of Patent: Sep. 29, 1998

[54] COMPUTERIZED VEHICLE LOG

[75] Inventor: Dan Kikinis, Saratoga, Calif.

[73] Assignee: Lextron Systems, Inc., Saratoga, Calif.

[21] Appl. No.: 686,519

[22] Filed: Jul. 26, 1996

[51] Int. Cl.[6] ..... G08G 1/017

[52] U.S. Cl. ..... 340/937; 340/541; 340/426; 340/539; 358/108; 364/29; 364/35

[58] Field of Search ..... 358/909, 108; 380/9; 364/29, 35; 340/540, 541, 937, 426, 425.5

[56] References Cited

U.S. PATENT DOCUMENTS 5,027,104 6/1991 Reid ..... 340/541
5,144,661 9/1992 Shamosh et al. ..... 380/9

*Primary Examiner*—Jeffery A. Hofsass
*Assistant Examiner*—Daryl C. Pope
*Attorney, Agent, or Firm*—Donald R. Boys

[57] ABSTRACT

A vehicle accident recording system employs a digital camera connected to a controller, a non-volatile memory, and an accident-sensing interrupter. The controller accesses images from the digital camera periodically and stores the images in a limited space of n sectors. After all n sectors are filled, each new image is overwritten to the oldest stored image. In the event of an accident, the interrupter causes the operation of storing images to cease. The result is a recorded history of n images spanning a time period up to the incidence of an accident of the number of images stored times the average time period between images. In a preferred embodiment the system has a communication port whereby the stored images may be downloaded after an accident to a digital device capable of displaying the images, thereby providing a visual record of the time period immediately preceding an accident. In alternative embodiments vehicle operating data is recorded, positional information is accesses and recorded, and on-board control routines convert raw data to meaningful information.

15 Claims, 4 Drawing Sheets

COMPUTERIZED VEHICLE LOG

FIELD OF THE INVENTION

The present invention is in the area of vehicle recording devices, and pertains more particularly to recording and transmitting records relating to vehicle operation and vehicle accidents.

BACKGROUND OF THE INVENTION

Many types of ground and water vehicles are used for conducting business. Automobiles are commonly used for delivery of small packages or messages, transporting passengers, and for renting to individuals and businesses. Trucks are typically used to ship industrial and commercial products between cities. Railroad cars and locomotives typically provide long-distant transportation of large volumes of industrial and commercial products to drop-off points in cities all over a continent. Waterborne carriers, such as barges and cargo ships, carry large bulk quantities of industrial and commercial products between ports around the world and on inland waterways.

Owner's of vehicles used for business purposes keep extensive records on their operation for both legal and practical reasons. Records for income-tax deductible business travel activity are important for individuals using their personal automobiles for business on a part-time basis. Trucking and railroad companies must maintain vehicle records for government tax reporting and safety requirements, as well as for planning for routine maintenance or repair.

At present time, much of the vehicle data recorded for business purposes is done by hand. Raw vehicle operation data is hand-recorded on an incremental basis, and then converted later into useful information. Examples of raw data obtained from automobile use by businessmen are travel start and stop odometer readings, start and stop locations, amount of fuel added, and start and stop times. Examples of raw data obtained by managers of truck fleets and railroad rolling stock are travel start and stop odometer readings, start and stop travel times, start and stop locations, engine run stop and start time, engine revolutions between start and stop times, engine temperature, and the amount of fuel added into a fuel tank.

Much of this raw data must be converted into useful information by hand calculation. For example, information calculated for a business automobile use, beside the raw data, are trip distance, overall distance between maintenance, and fuel usage. In another example, information calculated regarding fleet trucks and railroad rolling stock operations include such data as driver wheel-time or engineer throttle-time, distance traveled, engine run-time, and fuel-usage per mile or kilometer.

Vehicle fleet owners also have a need to locate their vehicles at any given time. For example, automobile rental agencies need to find their vehicles to call them in for routine maintenance. They also need to locate missing vehicles. Trucking, railroad and waterborne shipping companies need to locate their vehicles to inform their customers of shipments-in-progress. In present art, fleet managers commonly rely on telephone or radio calls, in-progress check points, and hand-written delivery reports. Auto rental agencies typically need to rely on law enforcement officers to locate missing vehicles.

The problem with the above methods of locating vehicles is that such methods are manpower intensive, time-consuming, costly processes that are subject to error, and also not timely.

Determining the cause of vehicle accidents is important for assigning responsibility, evaluating risk, and designing preventative methods. Currently, determining the cause of vehicle accidents, such as accidents involving automobiles, trucks, and railroad rolling stock, is very difficult. While accident investigative art has developed dramatically in recent years, much information gained in accident investigation is typically not factual and open to a variety of interpretations.

As an example of the difficulties encountered in accident investigation, unbiased witnesses to an accident often do not get a view of an accident until it is in progress, thus missing the instigating incident. Also, it is a well-known phenomena that several witnesses who see the same accident often provide different interpretations. As another example, a vehicle may be so badly damaged that it is not possible to determine the effect of a mechanical failure in causing or aggravating an accident. In still another example, speed factors, which accident investigators consider vital in determining the cause of an accident, are difficult to ascertain. While the extent of damage to a vehicle and length of skid marks are often valuable indicators of speed, they are open to conjecture because of other factors, such as the amount of damage on the vehicle before the accident occurred and the distance a vehicle travels before a driver applies brakes to cause skid marks.

What is needed is an apparatus and method to provide a user with readily accessible refined vehicle operation information without the problems associated with hand recording. Also needed is an apparatus and method to provide fleet managers a readily accessible tool to locate missing vehicles and to determine progress of shipments-in-route. Also needed is an apparatus and method to automatically provide comprehensive and factual vehicle accident data to enhance an accident investigator's ability to determine cause.

SUMMARY OF THE INVENTION

In a preferred embodiment an accident recording system for a vehicle is provided, comprising a digital camera; a flash memory having n sectors for recording digital images, one image per sector; a microcontroller connected to the digital camera and the flash memory; and an interrupter connected to the microcontroller; wherein the microcontroller accesses images from the digital camera periodically, stores the images sequentially in the sectors of the flash memory, and, after n images are stored, overwrites the oldest sector with each new image stored, and wherein the interrupter terminates operation of the vehicle accident recording system, thereby providing a visual record of a period of time immediately preceding an accident. The interrupter is an accident sensor, and senses an accident occurrence by either deceleration or rollover.

In some embodiments the interrupter comprises either an impact sensor or a rollover sensor, or both. In other alternative embodiments sensors are provided for collecting raw data, such as engine RPM and engaged gear, and the controller is adapted to execute code routines for converting the raw data to useful and meaningful information. In still other embodiments a Global Positioning System ability is provided, operated by the controller to store information about the location of the vehicle carrying the system at any point in time. The system in various embodiments is adapted to mount so the digital camera focuses in the direction of movement of the carrying vehicle.

The accident recording system according to various embodiments of the invention provides a fail-safe method of determining cause in vehicle accidents, and should have the effect of lowering costs in accident investigation and litigation, which could also lower insurance premiums.

DESCRIPTION OF THE PREFERRED EMBODIMENTS

Figure 1:
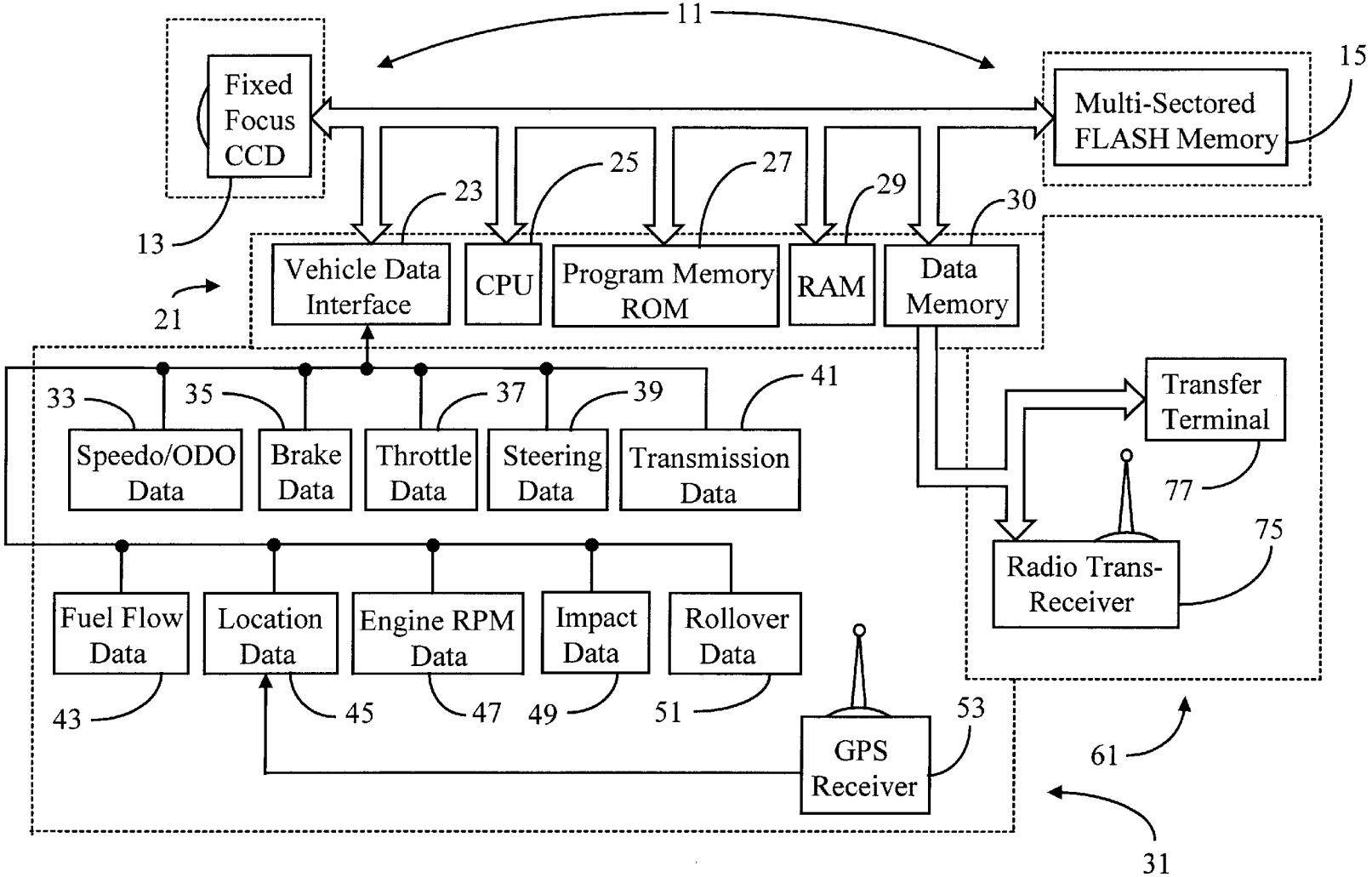
FIG. 1 is a block diagram of a vehicle computer log according to an embodiment of the present invention.

FIG. 1 is a representative block diagram of a vehicle computer log according to one comprehensive embodiment of the present invention. This embodiment has elements for many diverse functions, and in alternative embodiments, a subset of the functional elements may be used to provide a system tailored to specific needs.

In the comprehensive embodiment of FIG. 1, the vehicle computer log comprises a digital camera section 11, a computer section 21, a vehicle data section 31, and a data transfer section 61.

The purpose of digital camera section 11 is to provide an image record of a vehicle accident. Digital camera section 11 includes a fixed-focus charged-coupled device (CCD) 13 (a digital camera), and a multi-sectored flash memory 15. CCD 13 is a device small enough to be mounted on the backside of an interior rear view mirror, on a dashboard, or on a rear shelf of an automobile or truck without interfering with driver visibility. CCD 13 can be placed on other vehicles, such as railroad rolling stock and waterborne carriers, at any location from which an investigator might wish to view an accident-in-progress. CCD 13 comprises an array of photosensitive semiconducting cells, each of which transforms light into an electrical charge with a magnitude proportional to the intensity of the light. With light falling on an array of such cells an image of an object or objects viewed through a positioned lens is periodically sampled and recorded in a multi-sectored flash memory 15.

Flash memory 15 takes incrementally sampled CCD 13 images and stores each with time, date, and vehicle operational data. In this embodiment of the present invention, flash memory 15 has thirty-two sectors with a CCD 13 image sampled every 0.625 seconds, for a total of 20 seconds of recording. Other embodiments may sample CCD 13 images more or less often and store more or fewer frames without departing from the spirit and intent of the invention. Flash memory 15 stores each sampled image and other data onto the sequentially next sector in a circular replacement fashion. When all the sectors in flash memory 15 are filled, the oldest sector is overwritten. In this manner, at any point in time, the previous twenty seconds of visual history is retained in the camera.

Computer section 21 provides a means for system management and for processing and storing vehicle operation data. Computer section 21 includes a vehicle data interface 23, a central processing unit (CPU) 25, a vehicle computer log program memory 27, a random access memory (RAM) 29 for temporary storage, and a data memory 30. Vehicle data interface 23 provides an input/output (I/O) interface between computer section 21 and vehicle data section 31. Central Processing Unit (CPU) 25 obtains data and instructions from program memory 27, and data memory 30 through RAM 29, and carries out vehicle log program instructions. Program memory 27 provides program instructions for obtaining, calculating, and storing video and vehicle data. RAM 29 provides a medium to move program instructions and data from and to places as determined by program software. Data memory 30 provides storage for vehicle data records which can be accessed whenever a user requires.

Vehicle data section 31 comprises vehicle operation transducers for capturing data useful for vehicle accident investigation. Vehicle data comes from sensors at the vehicle's operable units, such as at a braking system's master cylinder or at a steering systems gearbox. For accident recording purposes, vehicle data are sampled and recorded at the same time as each sampled image from CCD 13.

After sampling, vehicle data is then converted to useful information, discussed below, and stored in non-volatile data memory 30. Alternatively, such data may be stored along with the sampled images in sectors of flash memory 15. In this case the oldest data (more than twenty seconds) is replaced as new data is recorded, for a twenty second history, just as in the digital camera feature of the invention.

Useful sensor data recorded for accident investigation in this embodiment includes, but is not limited to, speedometer and odometer data 33, braking data 35, throttle data 37, steering data 39, transmission data 41, and engine revolutions per minute (RPM) data 47. All this data is essential information that accident investigators need to adequately evaluate accident cause. In other embodiments different vehicle accident-related data may be recorded without departing from the spirit and scope of the present invention.

In the present invention, vehicle data is provided to the accident investigator as specific data, removing much of the ambiguity found in current accident investigative art.

Impact sensor 49 and/or rollover sensor (inclinometer) 51 provide a signal to computer section 21 (FIG. 1) when an accident occurs. Routines in program software sample and record one more CCD 13 image and one more instance of vehicle operation data sampled, then terminate all image and data recording. Impact sensor 49 also measures collision impact (deceleration G-force) or maximum rollover data in the last sector of recorded data.

The result of the mode of operation is that the last twenty seconds of image and vehicle data are recorded in flash memory 15 and/or data memory 30. The recorded image and vehicle data provides a permanent record which accident investigators can retrieve for their use through data transfer section 61, as discussed below.

Vehicle data section 31 also provides routine vehicle operation and location data that are recorded in data memory 30 for use by individuals using their private vehicle for business, and vehicle fleet managers, such as in trucking, taxicab, water carriers, railroad companies, and auto rental companies. Vehicle data section 31 comprises speedometer and odometer data 33, engine revolutions per minute (RPM) data 47, fuel flow data 43, location data 45 and global positioning system (GPS) receiver 53, in addition to the useful accident data discussed above. In the case of non-accident data, the recording is continuous rather than limited to a twenty second prior window.

Speedometer and odometer data 33 provided data regarding incremental speed and odometer readings which, in conjunction with location data 45, are raw data for CPU 25 (FIG. 1) to calculate trip distance and average speed. Such refined information has many uses, such as aiding a shipping manager to determine optimum shipping routes and monitoring driver and railroad engineer safety practices. Speedometer and odometer data 33, in conjunction with engine RPM data 47, can tell the amount of time a vehicle's engine is running without movement of the vehicle, to monitor driver wheel-time or engineer throttle-time.

Engine RPM data 47 also can be used to help a shipping or fleet manager determine when a vehicle should be routed for routine maintenance or overhaul.

Fuel flow data 43, in conjunction with speedometer and odometer 33, is used to provide a driver with incremental and average fuel use, such as in miles per gallon (MPG) or kilometers per liter (KPL), to help the operator drive in a manner to make most efficient use of fuel. Incremental and average fuel use is also recorded in data memory for other uses, such as determining optimum shipping routes and when fuel efficiently degrades significantly to indicate a need for engine maintenance.

Location data 45 is provided to determine a vehicle's location at any desired time. Location data 45 is based on information derived from a Global Positioning System (GPS) receiver 53. The global positioning system (GPS) is a system of precisely positioned geostationary satellites that emit radio signals to provide standard reference points from which surface instruments can determine geographic location on earth. Receiving signals from two or more GPS satellites, GPS receiver 53 on a computerized vehicle log provides GPS satellite position information as location data 45. Computer section 21, using location data 45 and program software algorithms, triangulates a vehicle's geographical position. A vehicle's geographical position can be displayed on a map inside the vehicle and/or be recorded in data memory for future access.

Location data 45 is useful to a businessman using a private auto to record business trip expenses. A vehicle computerized log according to the present invention automatically calculates and records in data memory 30, distances traveled to and from GPS-derived locations for tax or other business management uses. Location data 45 is also useful for owner's of auto, truck, railroad rolling stock, and waterborne shipping vehicles in tracking the location of shipping-in-progress. Customers, such as producers of industrial products, routinely interrogate shipping managers of the location of their inbound and outbound shipments. With accurate and timely shipment-in-progress locations they can affirm, or be prepared to adjust, their production and product delivery schedules.

In an era where a large number of manufacturers are turning to just-in-time inventory methods, the ability to locate shipments-in-progress is a critical issue.

Data transfer section 61 provides a means for a user to transfer vehicle operational data and accident image and vehicle data, which are stored in flash memory 15 and data memory 30. Data transfer section 61 comprises transfer terminal 77 and radio trans-receiver 75.

Transfer terminal 77 provides a mechanical interface to transfer data from the computerized vehicle log to a user's output medium, such as to a memory tape or disk, or to a printer. In any of several methods well-known in the art, a user connects such output medium to transfer terminal 77 and activates vehicle log program software to download data from data memory 30 to output medium. Data to be downloaded could be restricted to a user-defined time span or type of data, such as location data or accident data or both.

Radio trans-receiver 75 provides a means to access vehicle computerized log data from a remote site, such as a shipping manager's office. Upon a radio request from such a remote site, software routines in vehicle log computer section 21 download information from data memory 30 and/or flash memory 15 to radio trans-receiver 75. Trans-receiver 75, using any suitable radio transmission method known in the art, then transmits downloaded vehicle log data to a receiver in the shipping manager's office.

Vehicle log data is received and recorded at a users site using any suitable recording medium. Vehicle or image data downloaded to a remote site can be restricted to specific data as described above for a transfer terminal 77. Radio trans-receiver 75 is an especially useful for immediate access to a computerized vehicle log to find a vehicle's geographical location from a remote site. This could be in response to shipment-in-progress inquiries or to locate missing vehicles.

Figure 2:
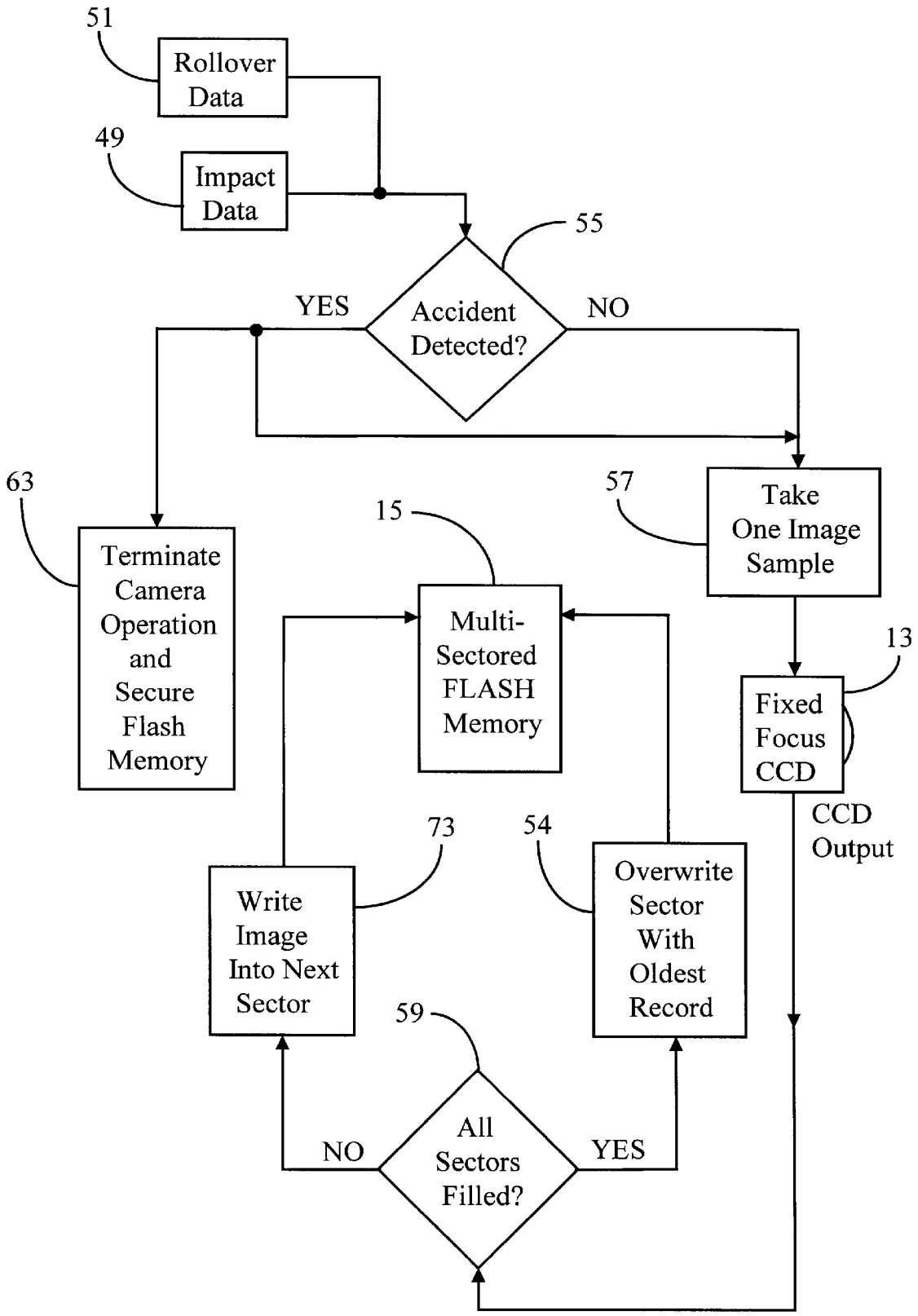
FIG. 2 is a flow chart showing the operation of an accident video recorder according to FIG. 1.

FIG. 2 is a flow chart showing the operation of an accident digital camera section according to FIG. 1. Accident digital camera section 11 operates in a continuously circular fashion as long as the vehicle ignition system is on and an accident has not occurred. Sensors provide impact data 49 or rollover data 51 to stop the digital camera section 11 operation when an accident occurs.

With no accident detected at point 55, routines in program software at point 57 sample a current image on fixed focus CCD 13. Software routines at point 59 then determine where the sampled image is recorded on flash memory 15. If all sectors in flash memory 15 are not filled with an image data from CCD 13, the current sampled image is written into the next available sector at point 73. If all sectors in flash memory 15 are filled with image data from CCD 13, the current sampled image overwrites the sector with the oldest recorded image at point 54.

An accident deactivates digital camera 11 operation. An accident is detected when predetermined impact or roll angles are exceeded. When an accident is detected at point 55, routines in program software at point 63 cause the computerized vehicle log to sample and record one more CCD 13 image and store it into flash memory 15. Routines then terminate digital camera section operation. The last image recorded in flash memory 15 has impact or rollover data, such as G-force or last roll angle, recorded with the image.

Figure 3:
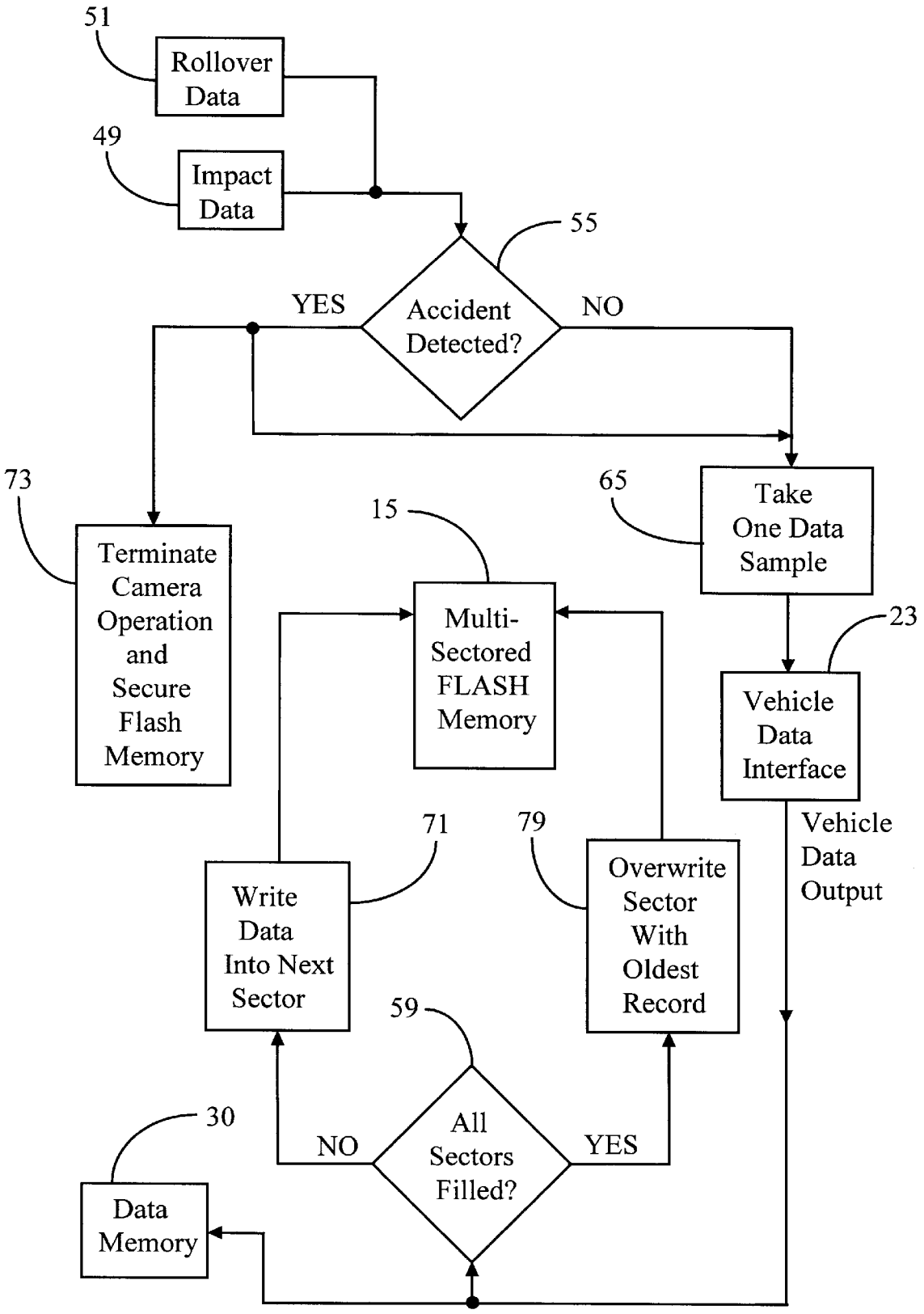
FIG. 3 is a flow chart showing the operation of a vehicle accident data recorder according to FIG. 1.

FIG. 3 is a flow chart showing the operation of vehicle data section 31 as it is used for accident data recording according to FIG. 1. Vehicle data section 31 operates in a continuously circular fashion as long as the vehicle ignition system is on, and an accident has not occurred. Sensors, not shown, provide impact data 49 or rollover data 51 to terminate vehicle data recording when an accident occurs.

With no accident detected at point 55, routines in program software at point 65 instruct a single sample of all relevant vehicle data, such as those described above in FIG. 1. Vehicle data sampling is done with each video image sample described in FIG. 2. Software routines at point 59 determine where sampled data are recorded in flash memory 15. If all sectors in flash memory 15 are not filled, the sampled vehicle data is written into the next available sector at point 71. If all sectors in flash memory 15 are filled, the sampled image is written into the sector with the oldest recorded data at point 79. Each data sample is recorded along with sampled CCD image data in flash memory 15, and may also, or alternatively, be recorded into data memory 30.

When an accident is detected at point 55, routines in program software at point 73 cause one more sample and recording of vehicle data, then terminates vehicle data section 31 operation.

Figure 4:
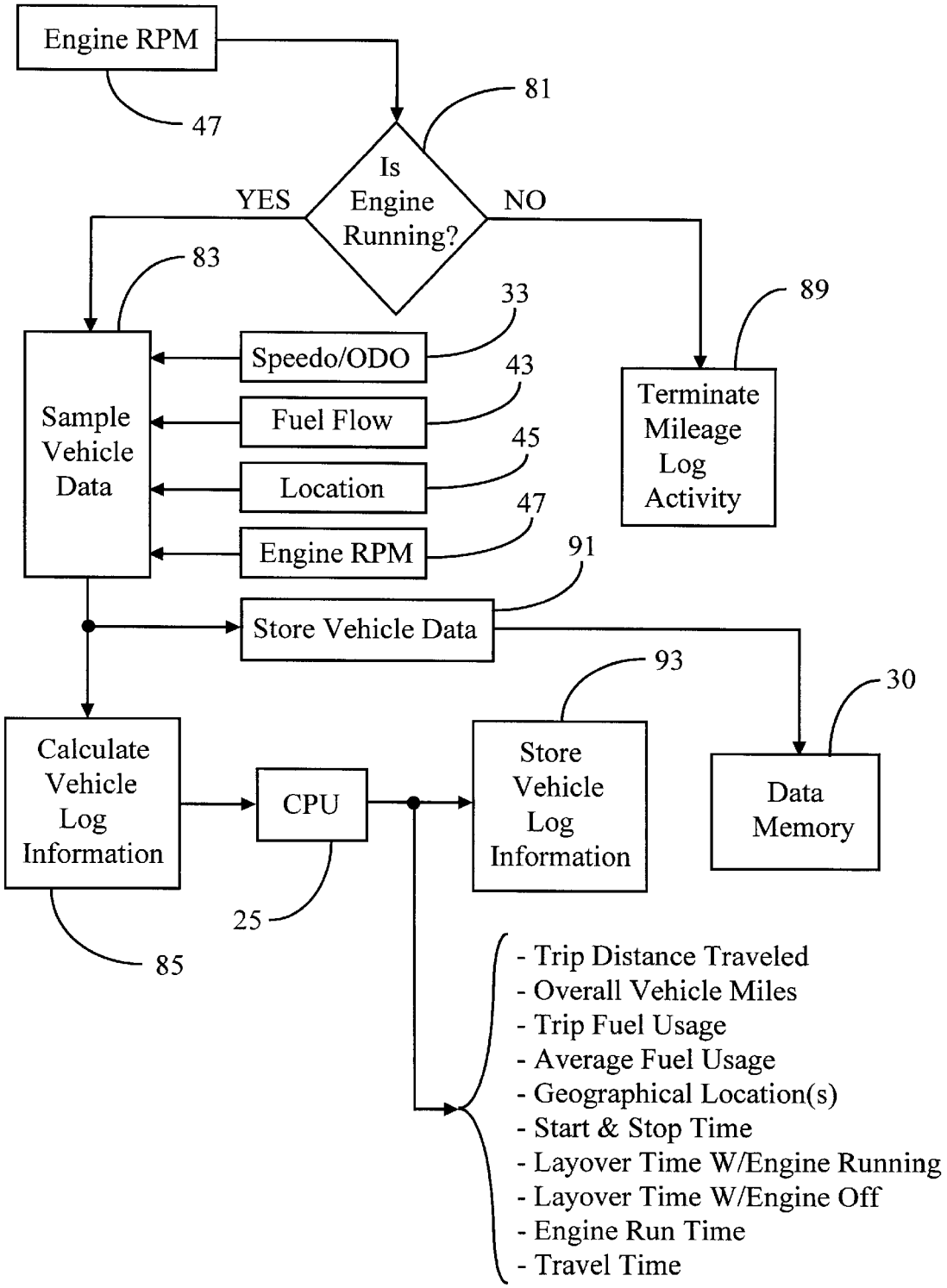
FIG. 4 is a flow chart showing operation of a vehicle data recorder according to FIG. 1.

FIG. 4 is a flow chart showing routine operation of a vehicle data log in a ground vehicle, such as an auto, truck, or railroad engine, according to FIG. 1. Computer section 21 and vehicle data section 31 work together to sample and record vehicle data as long as a vehicle engine is operating. Sensors of engine RPM are used to stop the recording of vehicle data when the engine is not operating.

With the engine operating at point 81, routines in program software at point 83 sample raw vehicle data, such as speedometer and odometer data 33, fuel flow data 43, and location data 45 and store this data in data memory 30 at point 91. Program software routines at point 85 then cause CPU 25 to calculate information that is useful, such as trip distance, vehicle miles, fuel usage, geographical location, start and stop time, layover time, engine run time, and trip travel time, or any other information required by a user. This information is then stored in data memory 30 at point 93.

When an engine is not operating, software routines at point 89 terminate all vehicle log activity.

It will be apparent to those with skill in the art that there are many alterations that may be made in the embodiments of the invention described herein without departing from the spirit and scope of the invention. For example, the invention described above has image data stored in flash memory 15 with certain vehicle operation data stored with the image. Non-image data may, however be stored elsewhere, such as in data memory 30. In another example, the invention described above has specified vehicle operation data to be sampled and stored in data memory 30. Other embodiments can use different vehicle operation data, such as brake or bearing temperature, and be consistent with the intent of the invention.

Also, the invention described above has vehicle data and accident image data accessed and radio-transmitted to a remote site upon a radio request. Other embodiment may have a programmed continuous or periodic radio transmissions of vehicle data and accident image data radio-transmitted to a remote site without a radioed request. In still another example, a computerized vehicle log operation in the invention described above samples and transfers vehicle operation data when an engine is running. In fact, other embodiments, such as a computerized vehicle log for a railroad car or rental vehicle, sampling and transfers of vehicle operation data can be done at anytime power is available to the computerized vehicle log.

There are, as will be apparent to those with skill in the art, many other variations that might be made in apparatus and methods described without departing from the spirit and scope of the invention.

What is claimed is:

1. An accident recording system for a vehicle, comprising:

a digital camera;

a flash memory having a limited number of sectors for recording digital images, one image per sector;

a microcontroller connected to the digital camera and the flash memory; and an interrupter connected to the microcontroller;

wherein the microcontroller accesses images from the digital camera periodically, stores the images sequentially in the sectors of the flash memory, and, after the last sector in the sequence is stored, overwrites the oldest sector with each new image, and wherein the interrupter terminates operation of the vehicle accident recording system, thereby providing a visual record of a specific and limited period of time immediately preceding an accident.

2. An accident recording system as in claim 1 wherein the interrupter comprises one or both of a deceleration sensing device and an inclinometer.

3. An accident recording system as in claim 1 further comprising sensors for sensing operating characteristics of the vehicle and a non-volatile memory, wherein the system records operating characteristics as well as visual images.

4. An accident recording system as in claim 1 adapted for mounting to one of a dashboard, a windshield, or a mirror bracket, with the digital camera focused through the windshield.

5. An accident recording system as in claim 1 further comprising a communication port adapted for connecting to an external digital device for downloading recorded images immediately preceding an accident, wherein the external digital device is adapted for displaying the downloaded images.

6. An accident recording system as in claim 1 further comprising a Global Positioning System (GPS) receiver for periodically determining and storing the precise position of the Earth's surface of the vehicle carrying the accident recording system.

7. An accident recording system as in claim 1 further comprising control routines adapted for converting raw sensed data to meaningful vehicle operating data.

8. A method for providing a visual record of events leading to a vehicle accident, comprising steps of:

(a) mounting a digital camera to focus in the direction of vehicle travel;

(b) connecting the digital camera to a controller, a non-volatile memory having a limited number of sequential sectors for storing images from the digital camera, and an interrupter;

(c) storing digital images sequentially in sectors of the non-volatile memory periodically;

(d) after all of the limited number of sectors of the non-volatile memory are filled, overwriting the oldest stored sector with each new image stored; and (e) stopping storing of images by action of the interrupter sensing an accident.

9. The method of claim 8 further comprising a step for downloading the recorded images after an accident to a digital device adapted for displaying the images.

10. The method of claim 8 further comprising a step for sensing and storing vehicle velocity associated with each recorded visual image.

11. The method of claim 8 wherein in step (c) the image data is stored with one or both of encryption and data compression.

12. A computerized vehicle log system comprising:

a CPU;

a digital camera;

a flash memory having a limited number of sectors for recording digital images, one image per sector;

a non-volatile memory connected to the CPU;

an interrupter connected to the CPU; and one or more transducers connected to the CPU and adapted for sampling vehicle operating characteristics;

wherein the microcontroller accesses images from the digital camera periodically, stores the images sequentially in the sectors of the flash memory, and, after the last sectors in the sequence is stored, overwrites the oldest sector with each new image stored, and wherein the interrupter terminates operation of the vehicle accident recording system, thereby providing a visual record of a period of time immediately preceding an accident, and wherein the CPU periodically polls the one or more transducers and stores time-related snapshots of vehicle operating characteristics in the non-volatile memory.

13. A computerized vehicle log system as in claim 12 wherein the one or more transducers measure one or more of speed, fuel flow, acceleration and deceleration, engine RPM, and engine temperature.

14. A computerized vehicle log system as in claim 12 further comprising a GPS receiver system adapted to compute surface location, and wherein the CPU uses the computed location information to process sampled operating characteristics creating processed information to be stored.

15. A computerized vehicle log system as in claim 12 further comprising a radio transceiver, and wherein the system is adapted to download stored information to remote radio equipped stations.

* * * * *